US006855101B2

(12) United States Patent
Trovinger et al.

(10) Patent No.: US 6,855,101 B2
(45) Date of Patent: Feb. 15, 2005

(54) SHEET FOLDING APPARATUS

(75) Inventors: Steven W. Trovinger, Los Altos, CA (US); Ross R. Allen, Belmont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 102 days.

(21) Appl. No.: 09/970,730

(22) Filed: Oct. 5, 2001

(65) Prior Publication Data

US 2004/0048728 A1 Mar. 11, 2004

(51) Int. Cl.[7] ..... B31F 1/00; B31B 1/26

(52) U.S. Cl. ..... 493/445; 493/405

(58) Field of Search ..... 493/437, 444, 493/434, 442, 424, 443, 446, 455

(56) References Cited

U.S. PATENT DOCUMENTS

| | | | | | |
|---|---|---|---|---|---|
| 1,215,613 | A | * | 2/1917 | Brown | 100/89 |
| 1,840,319 | A | * | 1/1932 | Jordhoy | 493/427 |
| 2,493,410 | A | * | 1/1950 | La Cour | 493/419 |
| 3,202,066 | A | | 8/1965 | Palmer | |
| 3,398,661 | A | | 8/1968 | Mathes et al. | |
| 3,434,399 | A | | 3/1969 | Palmer | |
| 3,711,086 | A | * | 1/1973 | Weist | 493/352 |
| 3,916,749 | A | | 11/1975 | Armelin | |
| 3,926,425 | A | * | 12/1975 | Pierce et al. | 493/444 |
| 3,954,258 | A | * | 5/1976 | Skipor et al. | 493/445 |
| 3,978,773 | A | | 9/1976 | Pinto | |
| 3,995,849 | A | | 12/1976 | Kistner | |
| 4,015,838 | A | | 4/1977 | Thurmann | |
| 4,041,849 | A | | 8/1977 | Tsukasaki | |
| 4,053,150 | A | | 10/1977 | Lane | |
| 4,101,121 | A | | 7/1978 | Rastorguyeff | |
| 4,221,373 | A | | 9/1980 | Muller Hans | |
| 4,226,410 | A | | 10/1980 | McIntosh, Sr. et al. | |
| 4,265,437 | A | | 5/1981 | Reist et al. | |
| 4,310,326 | A | | 1/1982 | Bellanca | |
| 4,419,088 | A | * | 12/1983 | Nemec | 493/444 |
| 4,496,339 | A | | 1/1985 | Moll | |
| 4,557,714 | A | | 12/1985 | Sabelstrom et al. | |
| 4,595,187 | A | | 6/1986 | Bober | |
| 4,614,512 | A | | 9/1986 | Capdeboscq | |
| 4,643,705 | A | | 2/1987 | Bober | |
| 4,717,375 | A | * | 1/1988 | Lundmark | 493/360 |
| 4,834,696 | A | | 5/1989 | Marschke | |
| 4,891,681 | A | | 1/1990 | Fiske et al. | |
| 4,893,803 | A | | 1/1990 | Petersen | |
| 5,028,193 | A | | 7/1991 | Misicka | |
| 5,080,339 | A | | 1/1992 | Hirahara | |
| 5,087,163 | A | | 2/1992 | Erdbories et al. | |
| 5,092,827 | A | | 3/1992 | McAdam, III et al. | |
| 5,114,392 | A | | 5/1992 | McAdam, III et al. | |
| 5,145,158 | A | * | 9/1992 | Frye | 270/45 |
| 5,147,276 | A | | 9/1992 | Stab | |
| 5,169,376 | A | | 12/1992 | Ries et al. | |

(List continued on next page.)

FOREIGN PATENT DOCUMENTS

| | | | | |
|---|---|---|---|---|
| EP | 1000894 | | 5/2000 | |
| WO | WO 00/18583 | * | 4/2000 | B42D/1/06 |

OTHER PUBLICATIONS

U.S. Appl. No. 09/970,748, filed Oct. 5, 2001, entitled "Thick Media Folding Method", Steven W. Trovinger et al.

(List continued on next page.)

*Primary Examiner*—Rinaldl I. Rada
*Assistant Examiner*—Paul Durand

(57) ABSTRACT

An apparatus for folding sheet material, including a fold blade, two fold rollers, a pinch foot for clamping against the fold blade, and drive means for moving at least one of the fold blade and the fold rollers into operable communication with one another, where each of the fold rollers rotates about an axis parallel to a longitudinal axis of the fold blade.

18 Claims, 13 Drawing Sheets

U.S. PATENT DOCUMENTS

| | | | | |
|---|---|---|---|---|
| 5,190,514 | A | | 3/1993 | Galvanauskas |
| 5,230,686 | A | | 7/1993 | McAdam, III et al. |
| 5,242,364 | A | | 9/1993 | Lehmann |
| 5,346,350 | A | | 9/1994 | Luhman et al. |
| 5,377,965 | A | | 1/1995 | Mandel et al. |
| 5,452,920 | A | | 9/1995 | Parker |
| 5,465,213 | A | | 11/1995 | Ross |
| 5,738,620 | A | | 4/1998 | Ebner et al. |
| 5,803,891 | A | | 9/1998 | Haan et al. |
| 5,937,757 | A | | 8/1999 | Jackson et al. |
| 5,957,823 | A | * | 9/1999 | Fan ..... 493/248 |
| 5,979,348 | A | | 11/1999 | Yaguchi |
| 5,997,459 | A | | 12/1999 | Kruger et al. |
| 6,090,032 | A | | 7/2000 | Bellanca |
| 6,094,225 | A | | 7/2000 | Han |
| 6,120,427 | A | | 9/2000 | Haan et al. |
| 6,193,458 | B1 | | 2/2001 | Marsh |

OTHER PUBLICATIONS

U.S. Appl. No. 09/970,840, filed Oct. 5, 2001, entitled "Sheet Folding Apparatus with Rounded Fold Blade", Steven W. Trovinger et al.

U.S. Appl. No. 09/970,877, filed Oct. 5, 2001, entitled "Sheet Folding Apparatus with Pivot Arm Fold Rollers", Steven W. Trovinger et al.

U.S. Appl. No. 09/971,351, filed Oct. 5, 2001, entitled "Variable Media Thickness Folding Method", Steven W. Trovinger et al.

* cited by examiner

SHEET FOLDING APPARATUS

BACKGROUND OF THE INVENTION

1. Field of the Invention

The present invention generally relates to folding sheet material and, more particularly, to a sheet folding apparatus using fold rollers arranged longitudinally with respect to a fold blade.

2. Background Information

A system for finishing printed sheets into booklets is described in PCT Document No. WO 00/18583 (hereafter referred to as "the Trovinger PCT"), hereby incorporated by reference in its entirety. The Trovinger PCT includes an operation where individual booklet sheets are folded using two drive motor assemblies. A first vertical drive motor assembly operates to immobilize a sheet by pressing it against a fold blade with a folder assembly. This first vertical drive motor assembly moves a set of fold rollers into contact with both the sheet and a longitudinal fold blade. The axes of rotation for the fold rollers are perpendicular to the fold blade used to fold each sheet. A second horizontal drive motor then operates to deform the sheet against the fold blade by reciprocating the set of fold rollers, which have been placed into contact with the sheet, back and forth along the fold blade to in effect crease the sheet. The number and spacing of these fold rollers are such that during horizontal movement of the fold rollers, at least one fold roller passes over every point along the portion of a sheet where a fold is to be formed.

The system described in the Trovinger PCT uses two separate motors to establish linear motion of fold rollers in two axes to create a fold. The time required to create a fold is the cumulative time of moving a folder assembly vertically and moving the fold rollers horizontally to crease the sheet.

Another folder apparatus is disclosed in U.S. Pat. No. 4,053,150 (Lane), hereby incorporated by reference in its entirety, which is directed to the prevention of corner dog-earring. The Lane patent includes a blade for forcing once-folded paper (e.g., a folded stack of newsprint) between a pair of rollers, thus creating a quarter-fold in the paper. Air flow jets and plates are used in the Lane patent to prevent bending of the paper edges and corners. However, the Lane patent is not capable of making precise, sharp folds and of ensuring proper paper alignment during a fold process.

It would be desirable to reduce the apparatus cost and the time required to form a precise fold in a sheet.

SUMMARY OF THE INVENTION

The present invention is directed to an apparatus that folds sheet material using a single motor and fold rollers arranged longitudinally to a fold blade.

According to an exemplary embodiment of the present invention, an apparatus for folding sheet material is provided, including a fold blade, two fold rollers, a pinch foot for clamping against the fold blade, and drive means for moving at least one of the fold blade and the fold rollers into operable communication with one another, wherein each of the fold rollers rotates about an axis parallel to a longitudinal axis of the fold blade.

According to a second embodiment of the present invention, a method for folding a sheet of material is provided, comprising the steps of feeding a sheet material into an area between two fold rollers and a fold blade, clamping the sheet material against the fold blade with a pinch foot, and moving the fold rollers and the fold blade relative to one another to form a fold in the sheet using the fold blade, wherein the fold roller rotates about an axis parallel to a longitudinal axis of the fold blade.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1A:
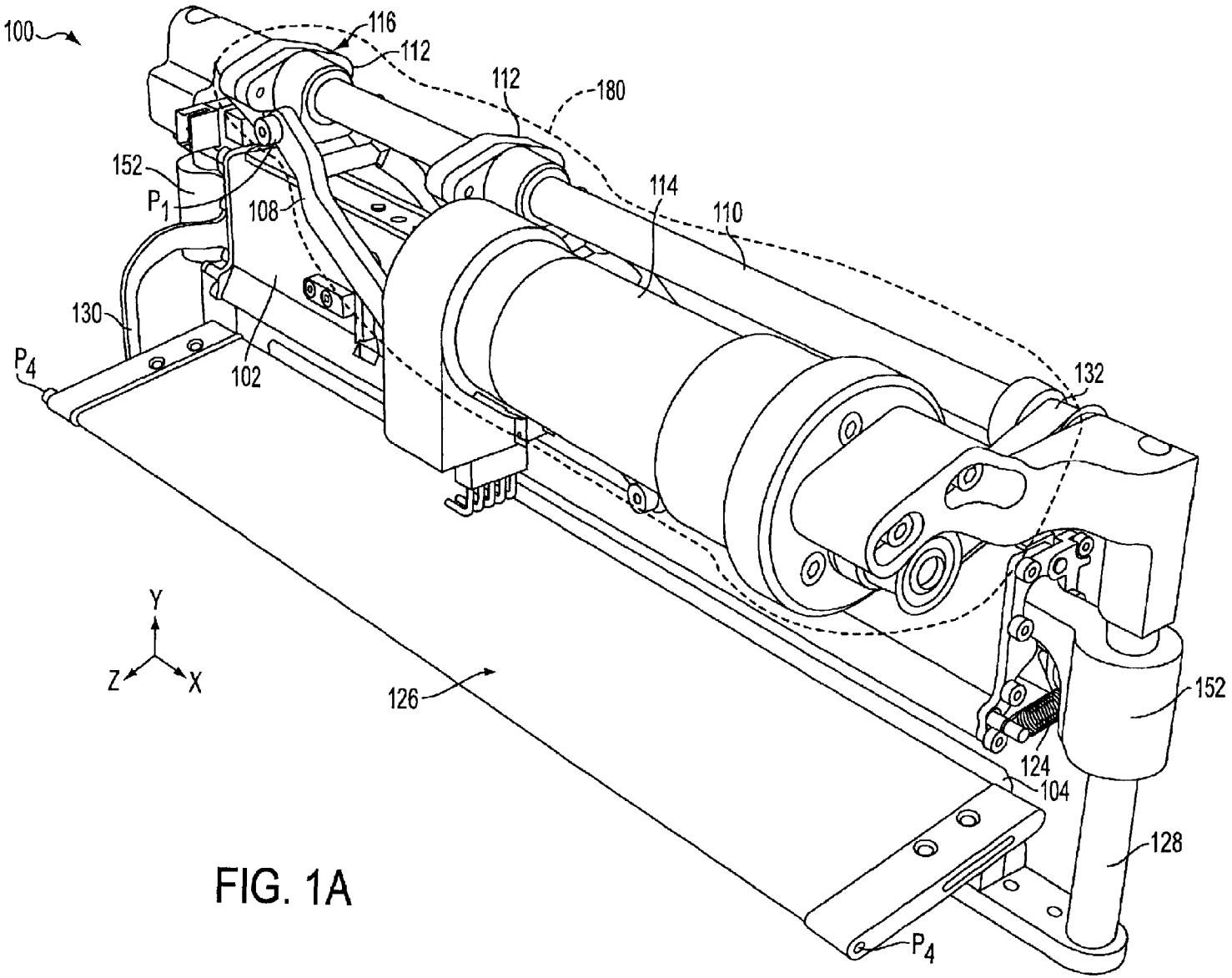
FIGS. 1A and 1B are perspective views of a sheet folding apparatus in accordance with an exemplary embodiment of the present invention.
Figure 1B:
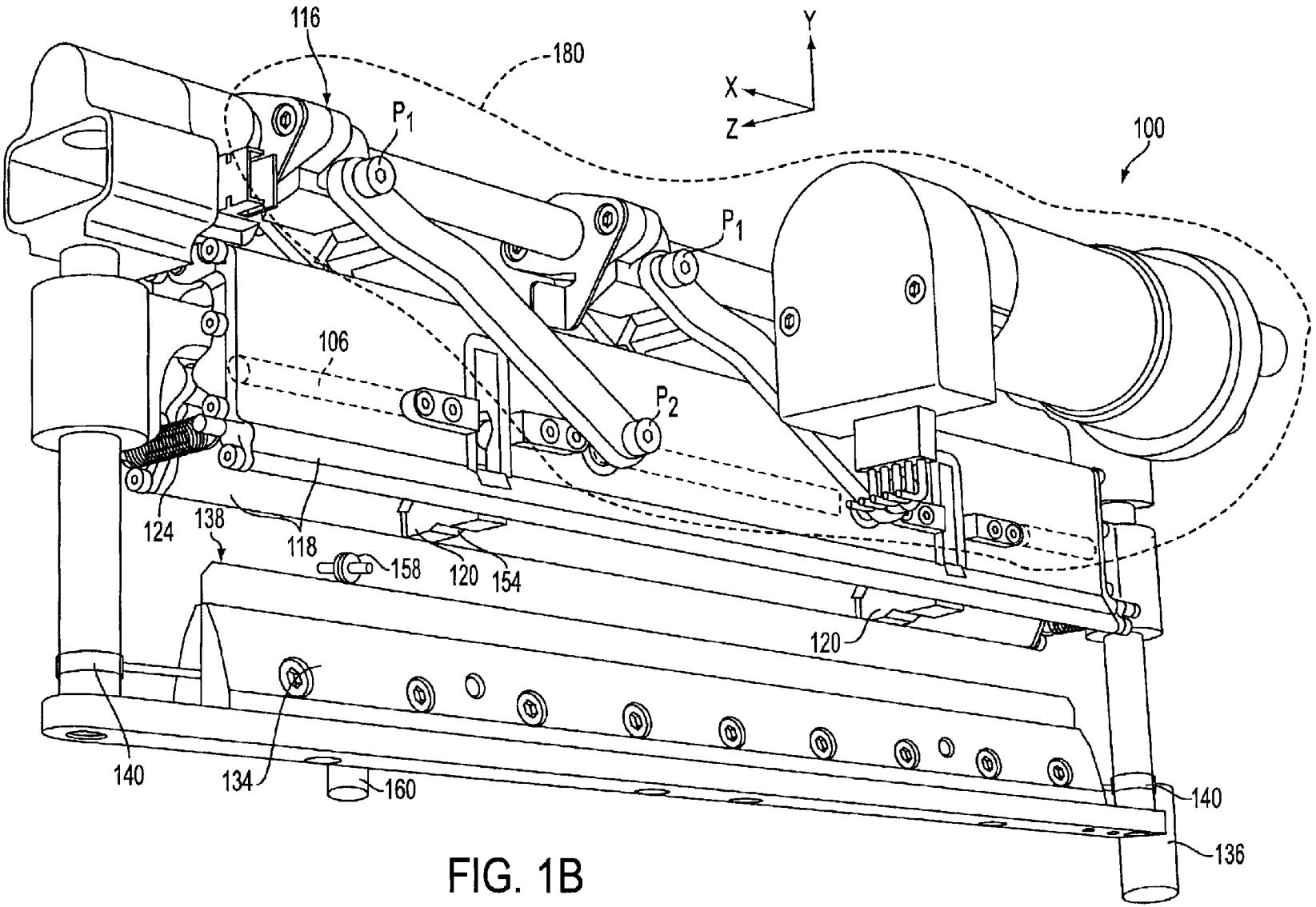

An apparatus for folding sheet material is represented as apparatus 100 in FIGS. 1A and 1B. The exemplary apparatus 100 includes a fold blade, such as fold blade 104 having a longitudinal axis along the x-axis of FIG. 1A. Fold blade 104 is shown to be held by a blade holder 134, but can alternatively be held by any other stabilizing structure or can be manufactured with blade holder 134 as a unitary component. Fold blade 104 can be fixed or can alternatively be movable (for example, along the y-axis of FIG. 1A, or any desired axis) by using a device such as blade motor 136. For example, blade motor 136 can use gears or any other means to translate fold blade 104 and blade holder 134 along rails 128, which are longitudinally arranged in the y-axis, using sliding arms 140 (shown in FIG. 1B) attached to blade holder 134. Such movement can be used to provide easier feeding of sheet material past fold blade 104.

Fold blade 104 can be made of metal or any other formable material, and can be shaped as a flat strip (as shown in FIGS. 1A, 1B, 2A–2C, 4A, and 4B) or can include a rounded shape (shown in FIGS. 3A–3C), these example being non-limiting, of course. For example, the cross-section of fold blade 104 (that is, in the plane including the y-axis and the z-axis) can alternatively be triangular, or blade faces 242*a* and 242*b* (indicated in FIGS. 2*a* and 2*b*) can be concave or convex, instead of flat as shown.

Figure 2A:
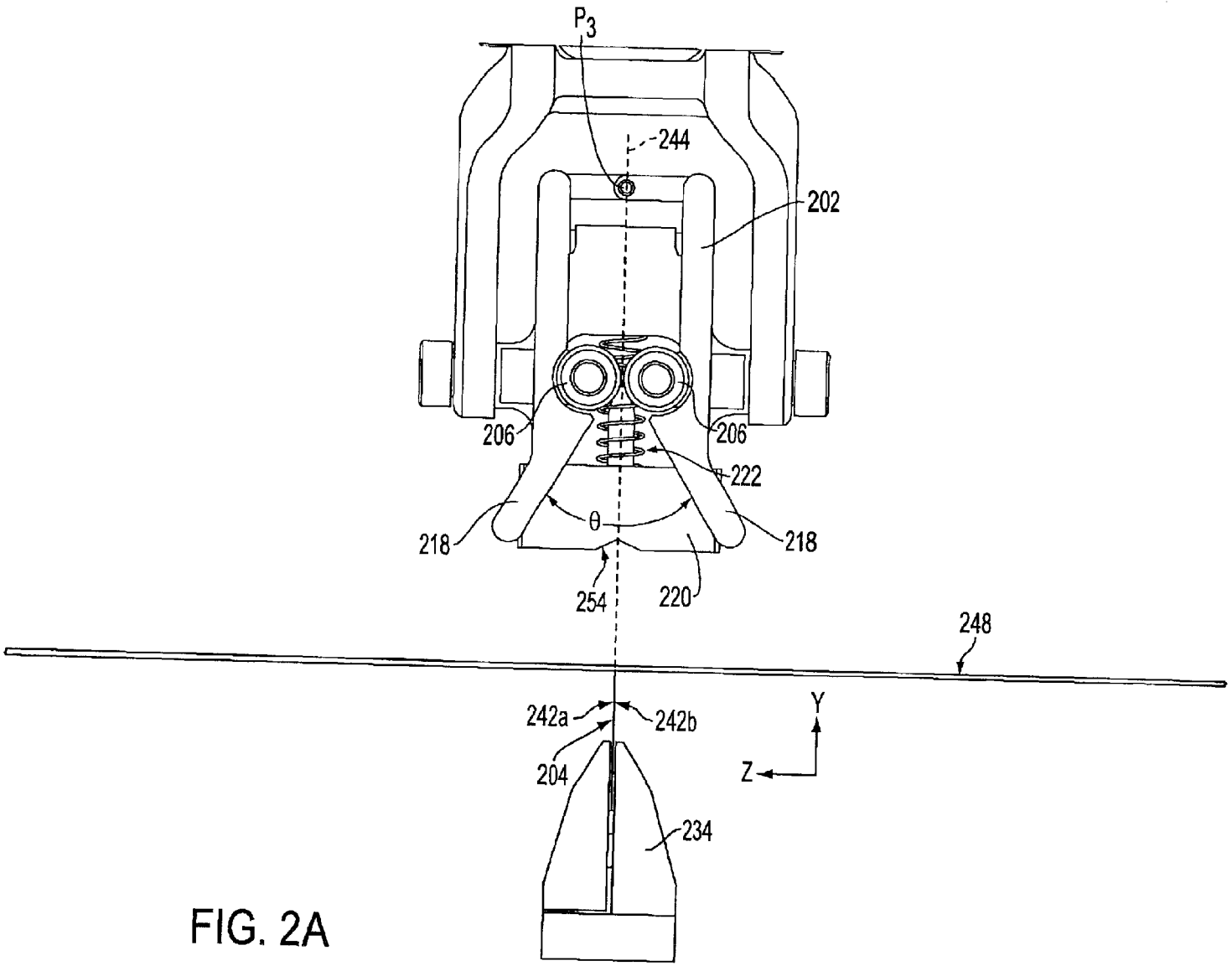
FIGS. 2A–2C illustrate in side view a process of folding sheet material in accordance with another embodiment of the present invention.
Figure 2B:
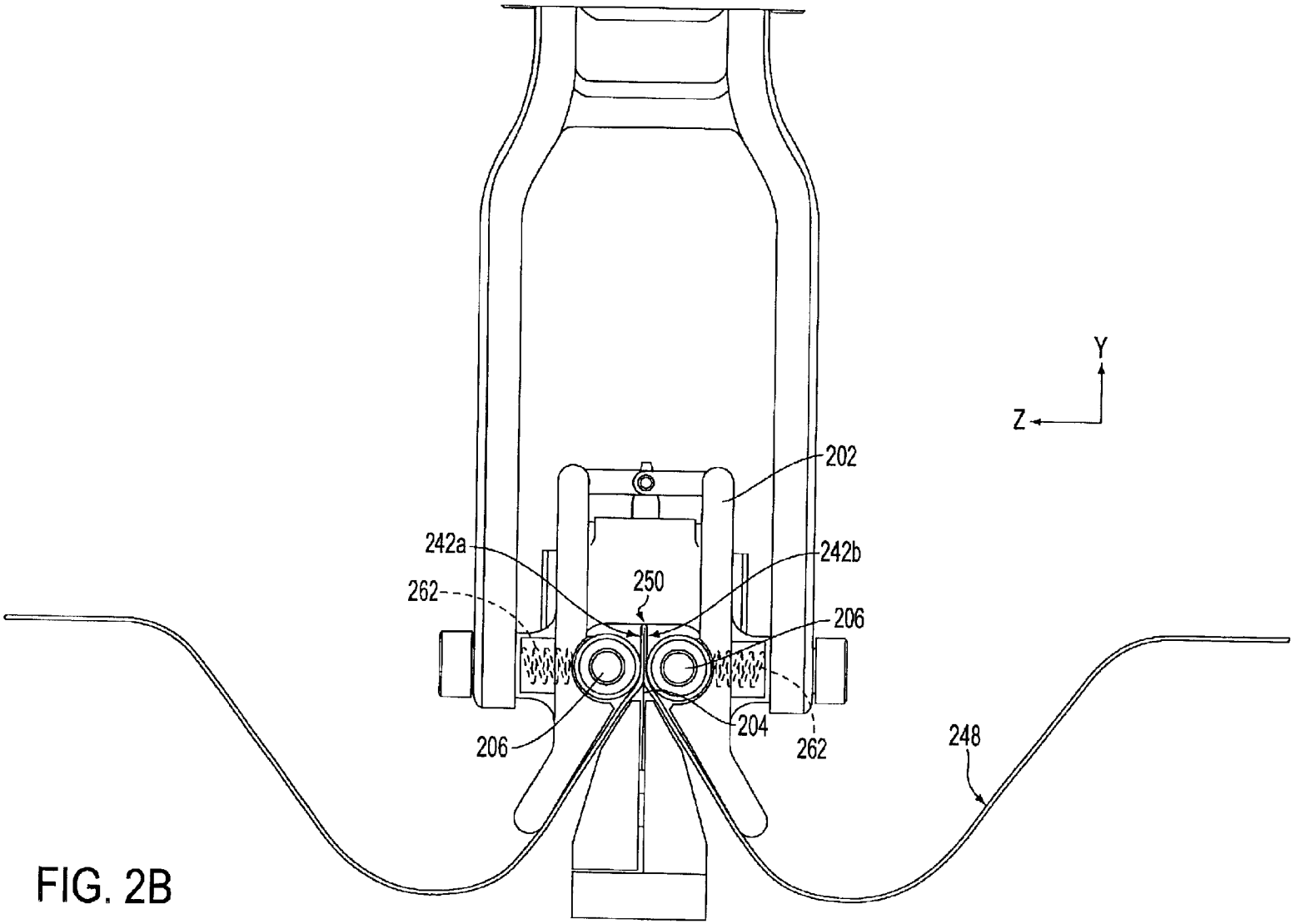
Figure 2C:
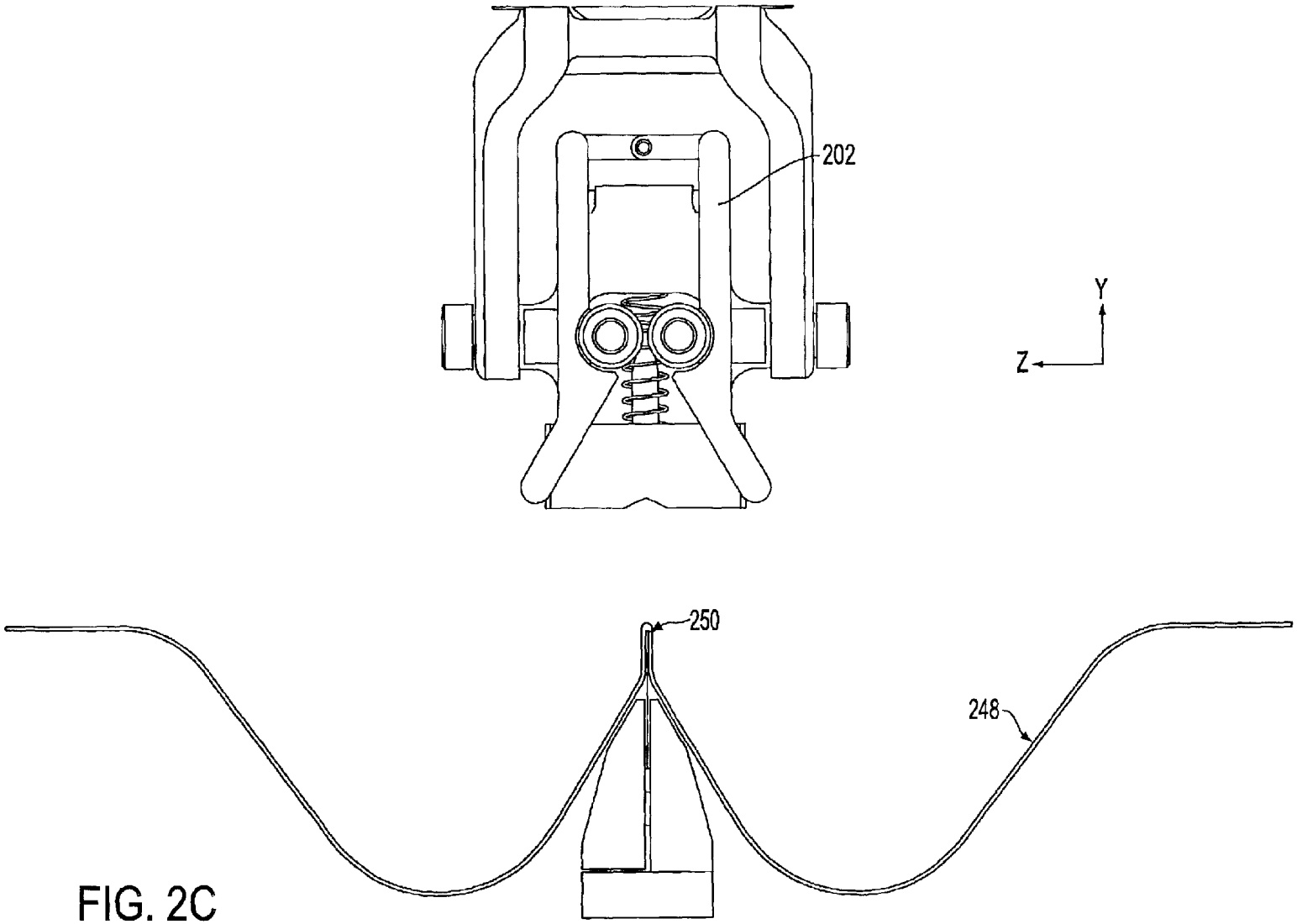

Apparatus 100 also includes two fold rollers, such as fold rollers 106, which are shown in FIG. 2A as two fold rollers 206, but can alternatively be of any number. As shown in FIGS. 2A–2C, fold blade 204 is positioned in a plane which passes between the two fold rollers 206. This plane is represented in FIG. 2A by dotted line 244. Each exemplary fold roller 106 rotates about an axis parallel to a longitudinal axis of the fold blade. In the FIG. 1A example, this axis of rotation is in the x-axis. Fold rollers 106 can be made of metal or any other formable material, and can be coated with an elastomeric or deformable material such as an elastomer. Also, fold rollers 106 can be circular in cross-section (as shown in the figures), or can alternatively have any other cross-sectional shape that can operate with fold blade 104 to create a fold in sheet material.

Figure 4A:
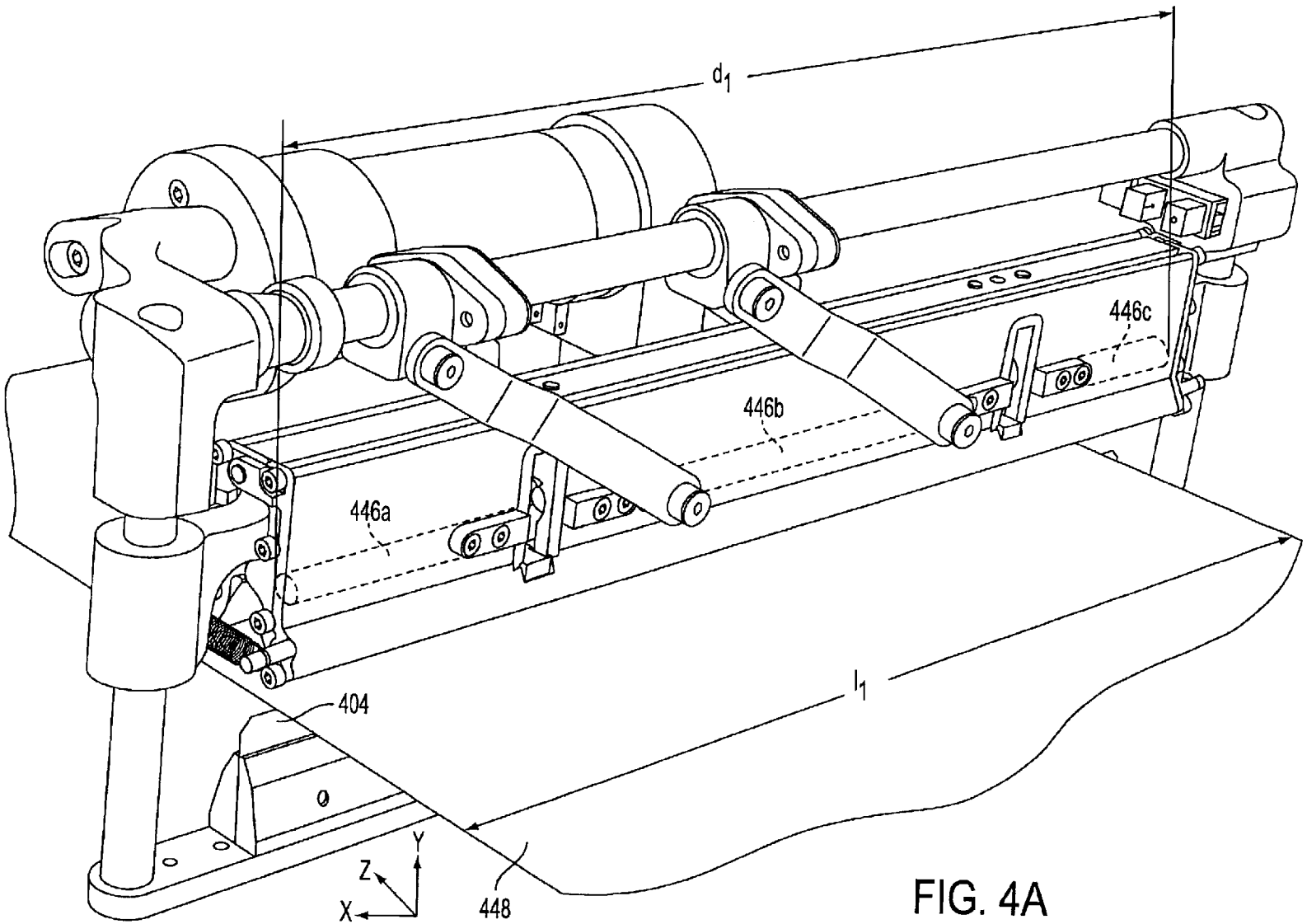
FIGS. 4A–4C illustrate in perspective and cutaway views the sheet folding apparatus of FIGS. 1A, 1B, and 3A–3C.
Figure 4B:
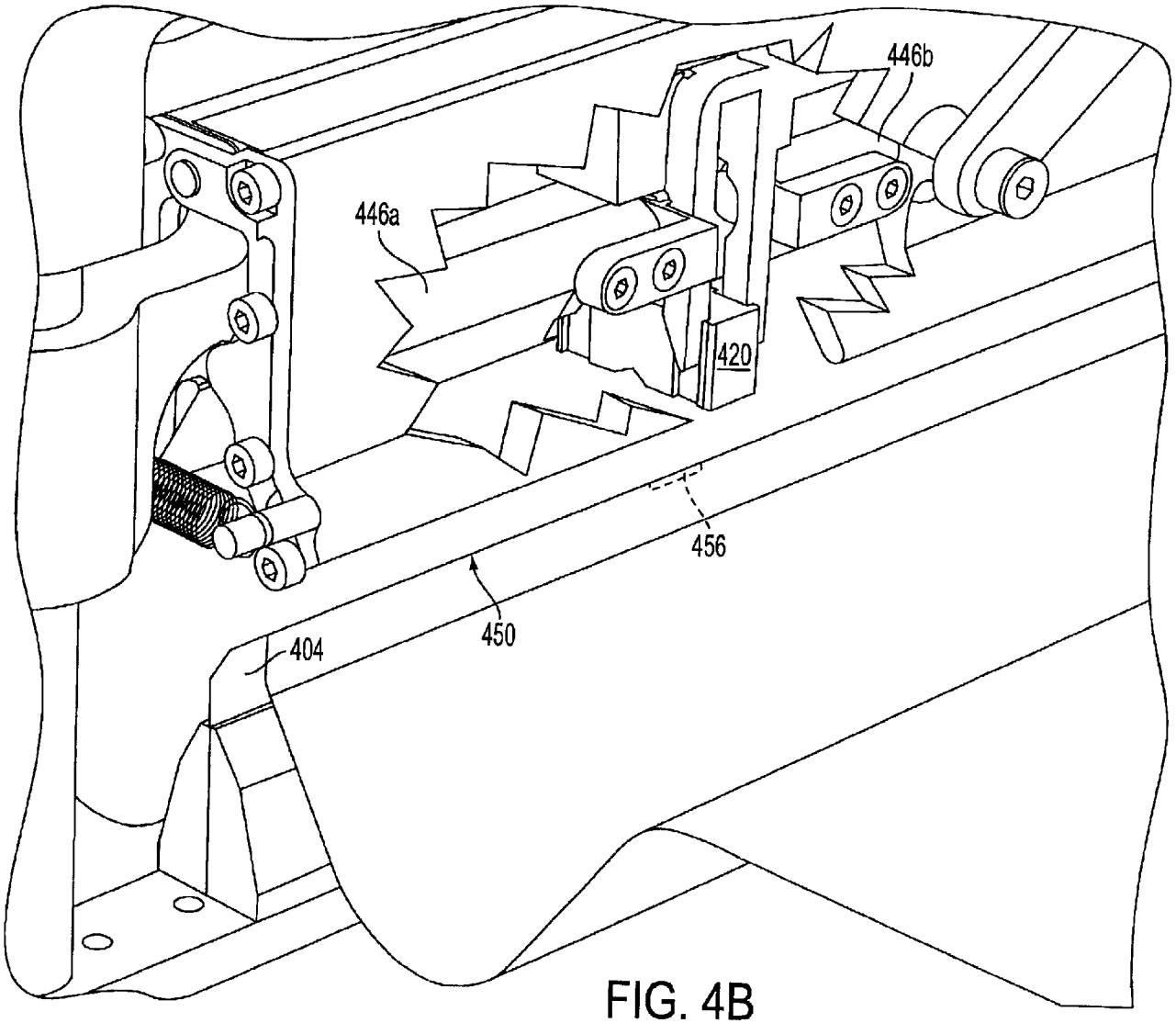

Each exemplary fold roller 106 includes multiple sub-rollers, such as in-line sub-rollers 446*a–c* in FIGS. 4A and 4B, wherein a cumulative length of the sub-rollers and spaces between the sub-rollers is at least the length of a desired fold. For example, in the FIG. 4A example, this cumulative length is represented as distance $d_1$, and includes the combined lengths of sub-rollers 446*a–c* and the spaces between them. Distance $d_1$ is at least as long as paper length $l_1$, which represents the length of a sheet material 448 along the longitudinal axis of fold blade 404.

A drive means, such as drive means 180 in FIGS. 1A and 1B, is provided for moving at least of the fold blade and the fold rollers into operable communication with one another. As referred hereon, "operable communication" means placement of the fold blade and/or the fold rollers relative to one another to achieve a desired fold in a sheet material. In an exemplary embodiment, drive means 180 includes a coupling, such as coupling 116, and an actuator, such as lead screw 110, attached to the coupling, wherein rotation of the lead screw in a first direction is operable to move the fold rollers against the fold blade to create a fold in a sheet material. In the examples shown in FIGS. 1A and 1B, drive means 180 includes coupling 116, lead screw 110, a motor 114, and a drive belt 132. Motor 114 can be of any conventional type (such as electric, pneumatic, or hydraulic), or can be of any other type. The exemplary lead screw 110 can be rotated by motor 114 via drive belt 132 or alternatively via any other power transmitting element, such as a chain, or can be replaced by another type of actuator, such as a piston.

Apparatus 100 also includes a housing, such as housing 102, to which the fold rollers are rotatably mounted, wherein the housing is attached to the coupling. In the FIG. 1B example, fold rollers 106 are attached to an interior portion of housing 102, and coupling 116 is attached to an exterior portion of housing 102. Housing 102 has a longitudinal axis in the x-axis and can be made of any formable material, such as, but not limited to, metal or plastic.

The exemplary coupling 116 includes traveling members 112, which interface with lead screw 110 through internally threaded portions and which travel along lead screw 110 upon its rotation as is known in the art. Coupling 116 also includes linking members 108, which are rotatably attached to traveling members 112 and housing 102 at pivot points $P_1$ and $P_2$ (shown in FIG. 1B), respectively, by any conventional or other pivoting means. Coupling 116 can alternatively include any other types of coupling components, such as chains or belts.

In the exemplary FIG. 1A embodiment of the present invention, drive means 180 moves the fold rollers along a linear path orthogonal to the sheet material to be folded. For example, due to a rotation of lead screw 110, linking members 108 rotate about pivot points $P_1$ and $P_2$ as traveling members 112 move along lead screw 110. Housing 102 is constrained along the x-axis of FIG. 1A by sliding arms 152 and rails 128, and rotation of linking members 108 causes housing 102 to move away from or towards fold blade 104 along a linear path. The combined use of lead screw 110 and coupling 116 can create very high forces in the −y-direction (i.e., towards fold blade 104) and can effectively fold sheet material ranging from, for example, conventional printer paper to heavy card stock, these examples being non-limiting. The single motion achieved by lead screw 110 and coupling 116 can alternatively be performed by other mechanical combinations, such as systems including cams, belt-and-pulleys, and gears, these examples being non-limiting.

Housing 102 includes a pinch foot, such as one of pinch feet 120, for clamping against the fold blade, wherein the pinch foot is elastically mounted to the housing. Each pinch foot 120 includes a pinch groove 154. The FIG. 1B example shows two pinch feet 120, although this number can alternatively be greater or lesser.

As shown in FIG. 2A, each exemplary pinch foot 220 can be attached to housing with a pinch spring 222; however, any other elastic attaching means can be alternatively used. Pinch foot 220 can be made of any formable material (metal and plastic being non-limiting examples) or of a deformable or elastomeric material. Pinch foot 220 includes a pinch groove 254 to locate and hold sheet material 248 against fold blade 204; pinch groove 254 is shown to have an inverted-V cross-section shape, but can alternatively be of any other cross-section shape (e.g., hemispherical).

As shown in a cutaway view of housing 402 in FIG. 4B, a pinch foot 420 is positioned in a space between two sub-rollers 446*a* and 446*b*. The spaces between sub-rollers 446*a–c* can be between about 8 or 9 mm in length along the x-axis, or can be greater or lesser.

Housing 102 also includes fold flaps, such as two fold flaps 118, for forcing a sheet material around the fold blade. As shown in FIG. 2A, fold flaps 218 (corresponding to fold flaps 118) can be arranged to have any angle θ between them such that blade holder 234 fits between fold flaps 218 during a folding operation. Fold flaps 118 can be manufactured with housing 102 as a unitary component or separately from housing 102, and can be manufactured from the same material as housing 102 or from a different, formable material. Fold flaps 118 can be pivotally attached to each other at a pivot point $P_3$ (FIGS. 2A–2C and 3A–3C) and can also be pivotably biased towards each other by using, for example, flap springs 124. This arrangement allows the adjusting of angle θ to accommodate different sheet material thickness. Alternatively, any other elastic connecting means can be used to bias the fold flaps 118 towards one another, or fold flaps 118 can be fixedly attached to each other.

FIGS. 2A–2C are exemplary illustrations of a method for folding a sheet of material. FIGS. 4A and 4B illustrate perspective and cutaway views, respectively, of the same exemplary embodiment. The method includes a step of feeding a sheet material into an area between at least one roller and a fold blade. This step is shown, for example, in FIG. 2A, where a sheet material 248 is fed between fold rollers 206 and fold blade 204 by, for example, an upstream assembly, such as a trimming device. Sheet material 248 can, of course, be fed in the +z-axis or the −z-axis. This step is also illustrated in the FIG. 4A example with the feeding of sheet material 448.

A step for clamping the sheet material against the fold blade with a pinch foot is provided in an exemplary method. For example, pinch feet 220 first engage sheet material 248 and press a portion of sheet material 248 where a fold is to be formed against fold blade 204 with pinch grooves 254, thus securing sheet material 248 to fold blade 204. In this way, pinch feet 220 define a fold position by ensuring proper alignment of sheet material relative to fold blade 204.

Also provided is a step of moving the fold rollers and the fold blade relative to one another to form a fold in the sheet using the fold blade, wherein each of the fold rollers rotates about an axis parallel to a longitudinal axis of the fold blade. In FIG. 2B, housing 202 is shown to be translated towards fold blade 204 due to operation of drive means 180 (e.g., rotation of lead screw 110 by motor 114, and movement of coupling 116). As housing 202 progresses further in the −y-direction, pinch feet 220 are forced back into housing 202 while maintaining pressure on sheet material 248 against fold blade 204, due to the action of pinch springs 222. At the same time, fold flaps 218 engage sheet material 248 at portions on either side of fold blade 204 and force sheet material 248 around fold blade 204. Depending on the material properties of sheet material 248, fold flaps 218 can pivot about pivot point $P_3$ to accommodate sheet material 248. The action of forcing sheet material 248 around fold blade 204 with fold flaps 218 initiates the formation of fold 250 without producing a sharp fold. This action also reduces the force required to initiate a fold.

Fold 250 (shown in FIGS. 2B and 2C) is formed by moving the fold rollers relative to the fold blade such that the fold blade and the sheet material pass between the fold rollers. In the FIG. 2B example, housing 202 moves towards fold blade 204 such that sheet material 248 is deformed between fold 204 and fold rollers 206 to form fold 250. Fold rollers 206 can be biased towards each other (e.g., as a result of being attached to biased fold flaps 218 or with the use of springs 262 or any other biasing means) such that fold rollers 206 press portions of sheet material 248 on opposite sides of fold blade 204 against blade faces 242*a* and 242*b*. By pressing and rolling fold rollers 206 against sheet material 248 and fold blade 204, a portion of sheet material 248 conforms to the shape of fold blade 204 and thus fold 250 is formed as a sharply defined fold in sheet material 248.

FIG. 2C illustrates the position of housing 202 after it has moved away from fold blade 204 (i.e., after fold 250 has been fully formed). As shown in FIG. 4B, a pinched portion 456 of fold 450 may not be as sharply formed as other portions of fold 450. This is due to the fact that sub-rollers 446*a* and 446*b* do not roll pinched portion 456 against fold blade 404 during a folding operation. Pinched portions 456 of a stack of sheet material 448 can be stapled together to form, for example, a booklet of folded sheets.

Figure 3A:
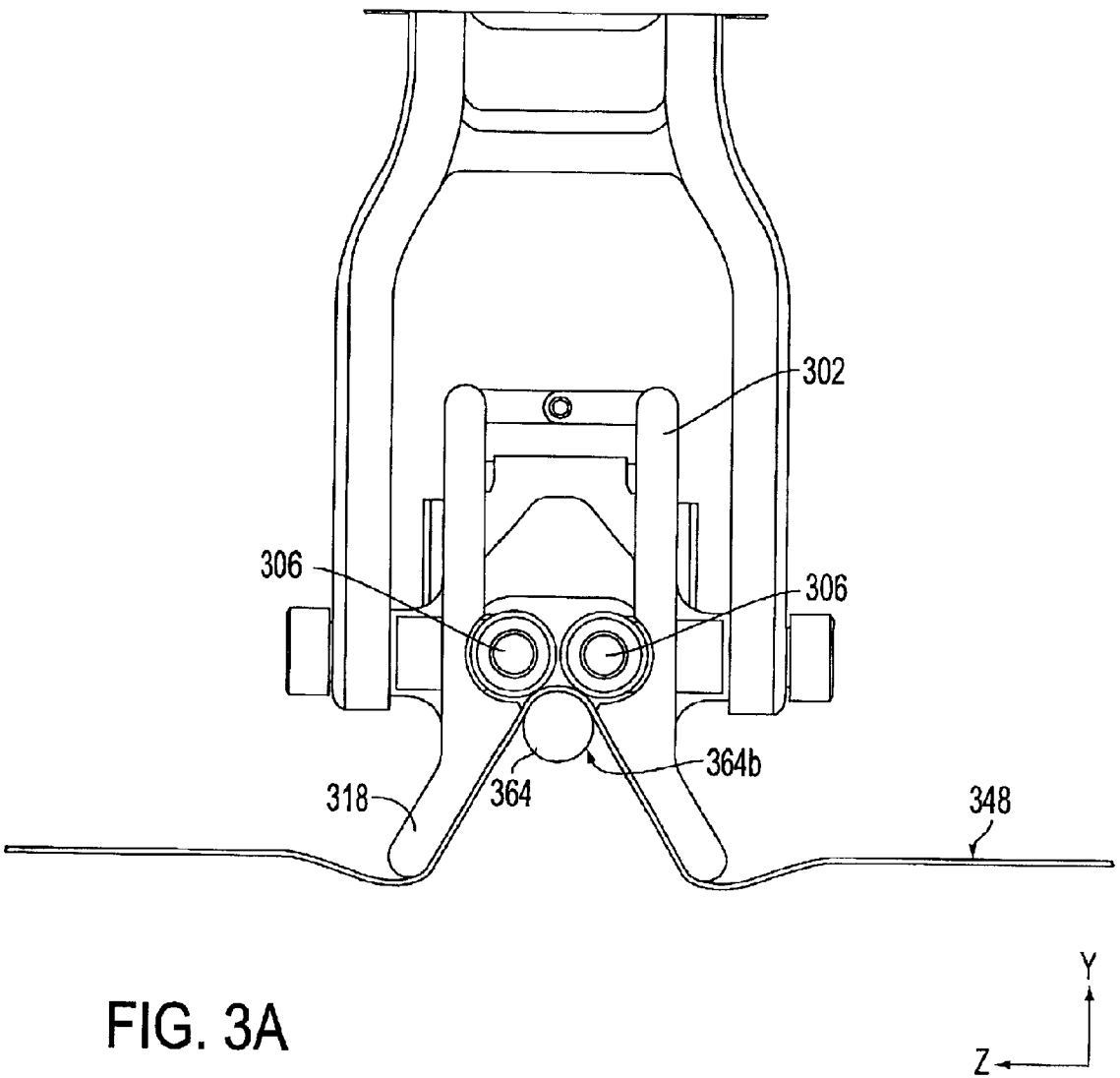
FIGS. 3A–3C illustrate a process of folding sheet material with a rounded fold blade in accordance with another embodiment of the present invention.
Figures 1, 3B:
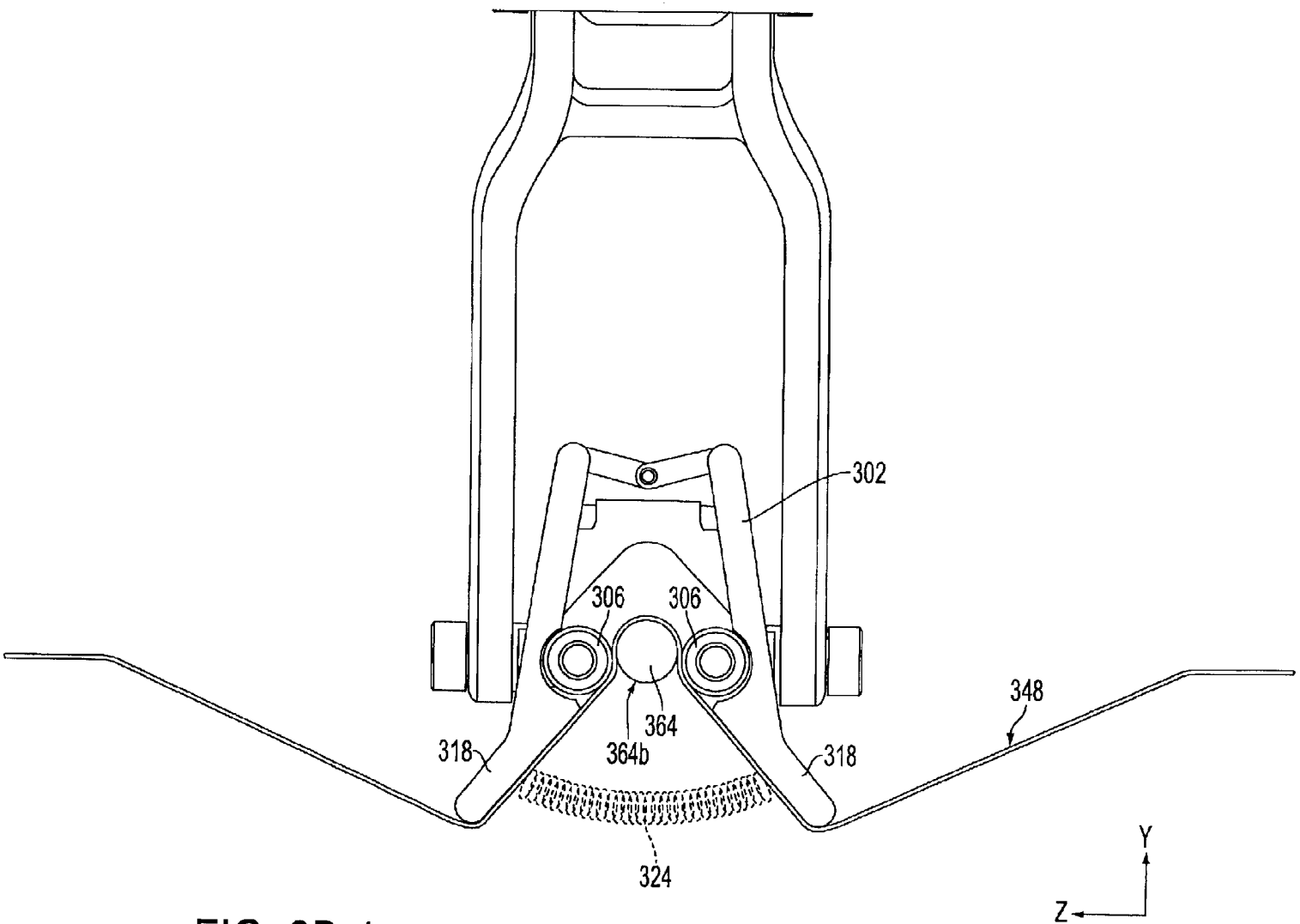
Figure 3C:
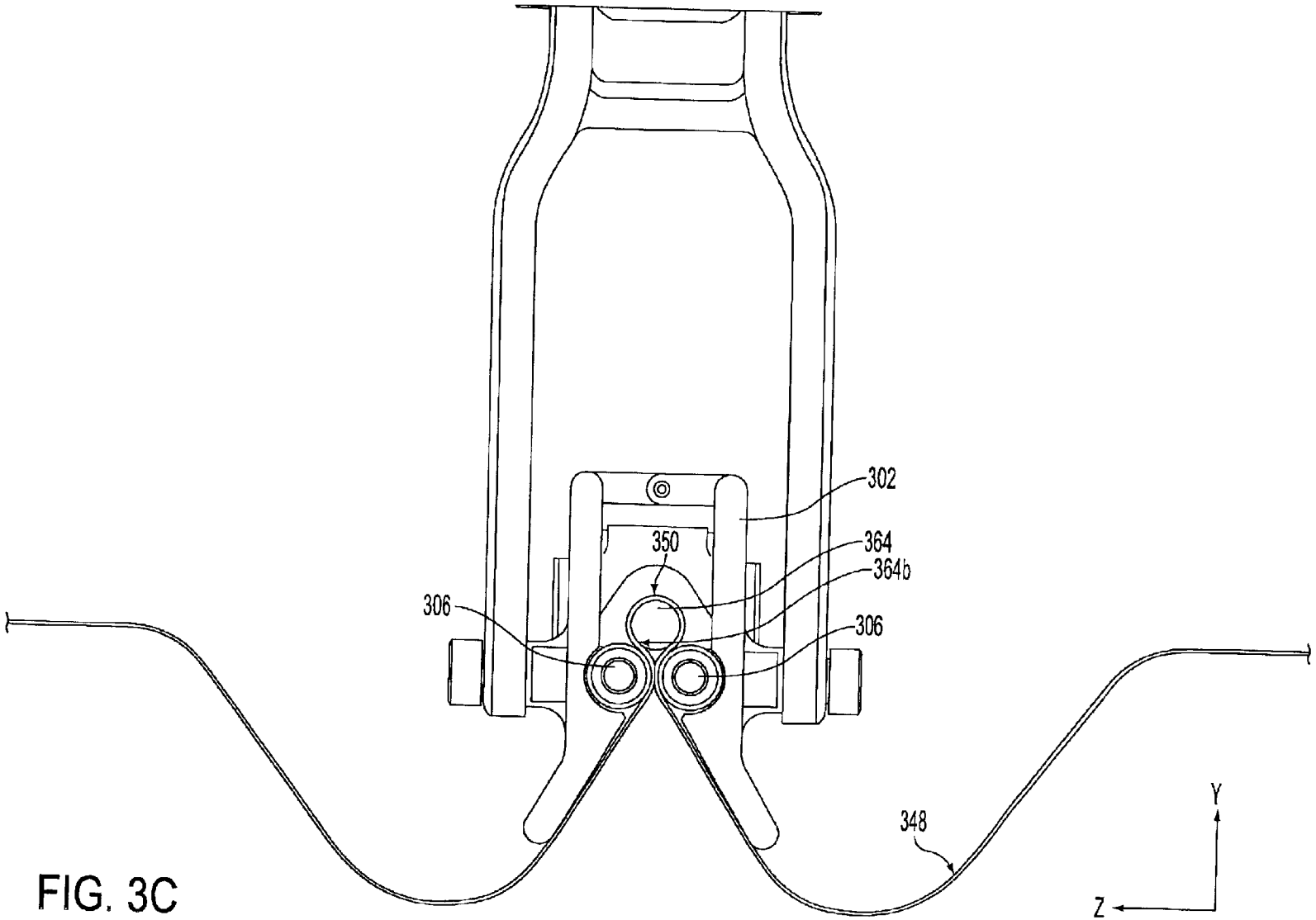
Figure 4C:
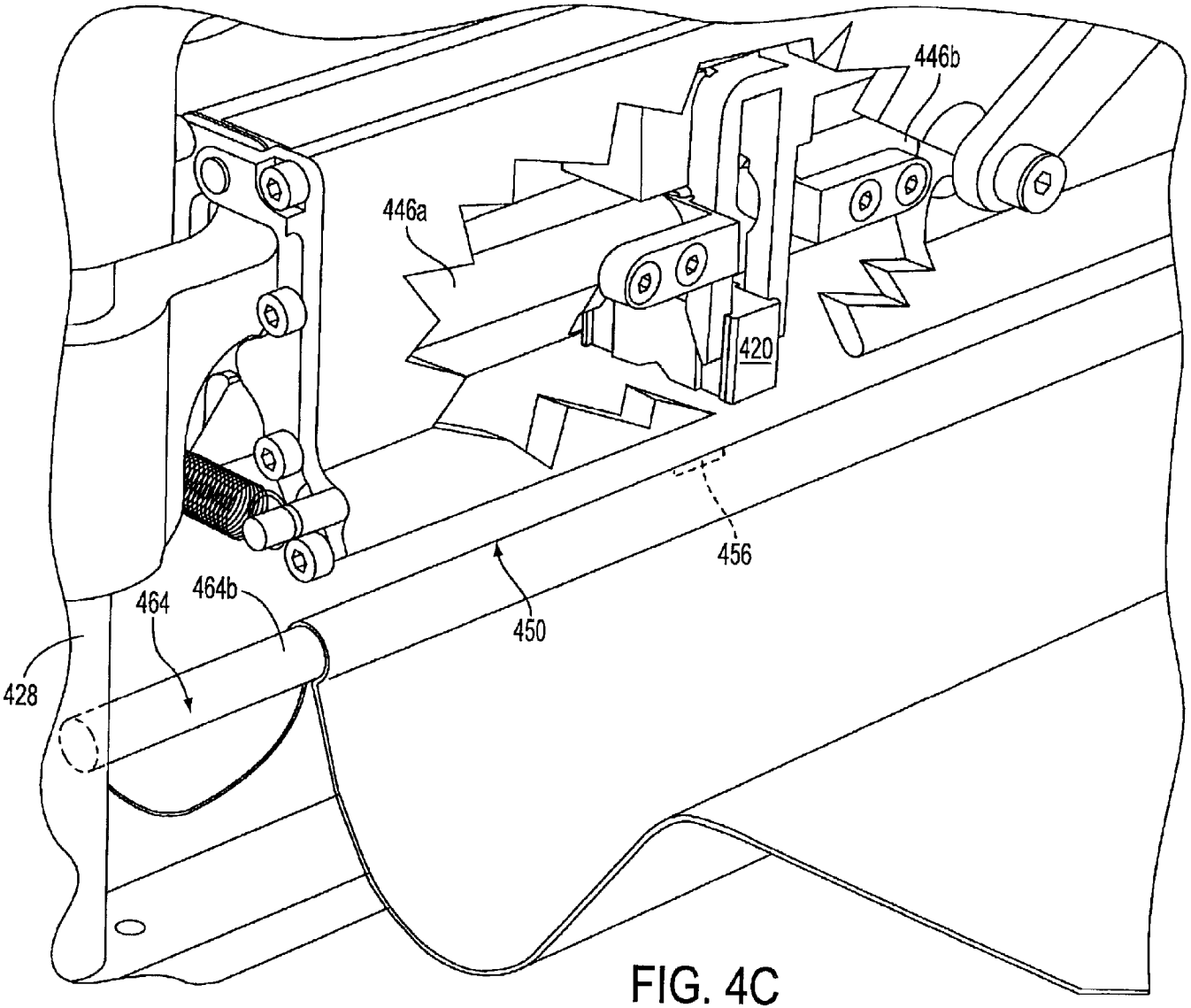

Alternatively, the above method can be performed with a fold blade with a rounded folding surface. As referred hereon, "rounded" means having at least in part a round periphery (i.e., some radii of curvature). For example, in the exemplary embodiments shown in FIGS. 3A–3C and 4C, rounded fold blade 364 is arranged as a single rod-like element, where either ends of rounded fold blade 364 can be fixedly attached to rails 428 (FIG. 4C). Rounded fold blade 364 can alternatively be movable along rails 428 in a fashion similar to that described above with respect to fold blade 104 and blade holder 134. Folding surface 364*b* of rounded fold blade 364 can be substantially circular in cross-section (as shown in FIG. 3A) or can have any other rounded contour. Fold rollers 306 and rounded fold blade 364 can be approximately equal in cross-sectional area (as shown in FIGS. 3A–3C) or can differ in size.

Rounded fold blade 364 can alternatively be attached to a fold blade such as fold blade 104, and can either manufactured from the same material or from a different material as fold blade 104. Rounded fold blade 364 can also be constructed with the fold blade as a unitary component or can be a separate element attached to fold blade 104. In the latter case, rounded fold blade 364 can be attached and removed from fold blade 104 in the embodiments illustrated in FIGS. 1A, 1B, 2A–2C, 4A, and 4B. Also, folding surface 364*b* can be a component separate from rounded fold blade 364 and can be manufactured from a material different from or identical to the material used to manufacture rounded fold blade 364. For example, rounded fold blade 364 can be made of a metal, while the folding surface 364*b* can be made of an elastic material.

The rolling and pressing of sheet material 348 against folding surface 364*b* of rounded fold blade 364 results in the creation of a rounded fold 350 in sheet material 348. Rounded folds in sheet material have several advantages over sharp creased folds. Whereas the pages of a sharply folded sheet tend to move apart from each other, pages of a sheet with a rounded fold tend to remain closed against one another. Also, booklets made of sheets with sharp folds tend to exhibit an effect known as pillowing, where the areas of sheet material near the folded edges spring outward. Rounded folds reduces this effect for the reason given above (i.e., rounded folds keep sheet pages closed together).

As shown in FIG. 3A, housing 302 advances towards rounded fold blade 364, and fold rollers 306 (which are constructed and arranged similarly to the above-described fold rollers 206) initially press sheet material 348 against the top of folding surface 364*b* as shown in FIG. 3A. Fold flaps 318 can be used to initiate the formation of fold 350 in sheet material 348 in a manner described above with regards to fold flaps 218. Pinch feet 420 (FIG. 4C) can be used to secure sheet material 348 against folding surface 364*b* in a manner described above with regard to pinch feet 220.

Figures 2, 3B:
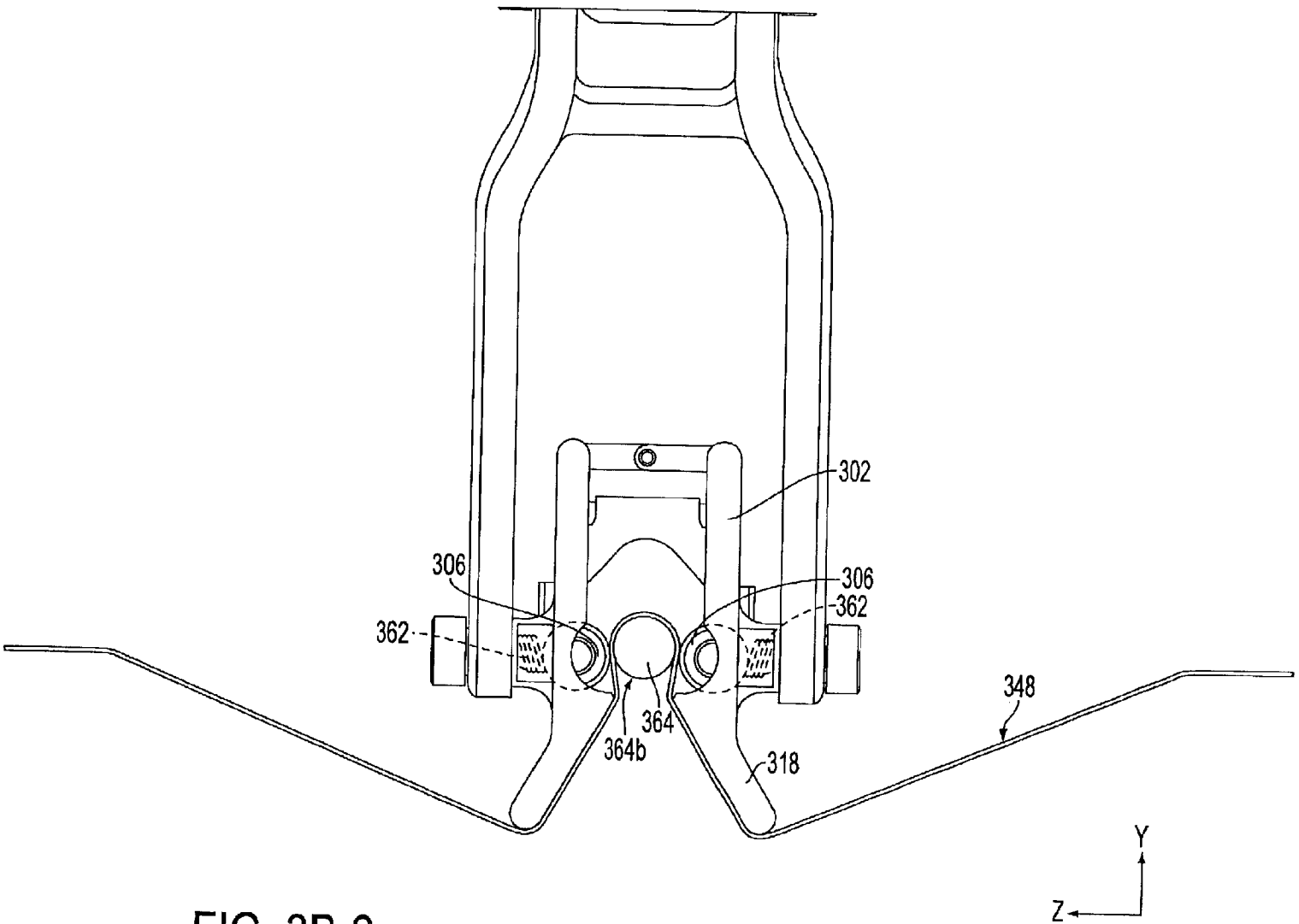

As housing 302 continues it advancement, shown in alternate embodiments FIGS. 3B-1 and 3B-2, fold rollers 306 are forced away from each other due to the cross-sectional shape of rounded fold blade 364. In the FIG. 3B-1 example, fold rollers 306 are rotatably mounted on fold flaps 318 such that fold rollers 306 are biased towards each other. For example, fold flaps 318 are pivotably biased towards each other about pivot point $P_3$ by flap spring 324. Because fold rollers 306 are mounted onto fold flaps 318 in the FIG. 3B-1 example, they too are biased towards one another and rotate about pivot point $P_3$ when fold flaps 318 move. Alternatively, in the FIG. 3B-2 example, fold rollers 306 are not mounted on fold flaps 318 and are biased towards each other by springs 362. In both of these embodiments, fold rollers 306 are biased towards each other (i.e., by flap spring 324 or by springs 362) and, therefore, they continue to roll against and press sheet material 348 around folding surface 364*b* as housing 302 proceeds toward rounded fold blade 364.

The FIG. 3C embodiment illustrates the position of fold rollers 306 when housing 302 has completed its advancement in the −y-axis direction. During this advancement, fold rollers 306 press sheet material 348 against a substantial amount of folding surface 364*b*, thereby forming a rounded fold 350 in sheet material 348. In an embodiment where rounded fold blade 364 is not attached to fold blade 304 or blade holder 334, but is arranged as a single rod (shown in FIGS. 3A–3C and 4C), fold rollers 306 can press sheet material 348 against most of the surface of rounded fold blade 364 (i.e., each roller 306 can travel around an 180 degree arc), depending on the size of fold rollers 306 relative to rounded fold blade 364. After housing 302 has completed its advancement, it retracts in the +y-direction, and the above-described process is reversed. In this way, each sheet of sheet material 348 can be pressed against folding surface 364*b* twice by fold rollers 306 to insure a rounded fold of high integrity.

It is sometimes necessary to vary certain characteristics of each individual sheet, as in the sheetwise booklet-making system described in the Trovinger PCT, for example. In regards to the creation of a booklet with rounded folds, it is necessary to vary the shape or size of the rounded fold of each sheet. For example, the outermost or cover sheet of such a booklet may require a larger rounded fold than the rounded folds of the sheets positioned between the pages of the outmost sheet.

To adjust the size and/or shape of rounded folds, two general methods are described. In one method, the advancement of housing 302 is controlled (e.g., by a controlling unit connected to motor 114) based on individual sheet information, such as a sheet's position within a completed booklet and upon the accumulated thickness of other booklet sheets positioned between the sides of the folded sheet. For example, when a rounded fold is to be formed on a sheet that will eventually be the outermost sheet for a booklet, housing 302 may be controlled to advance such that fold rollers 306 do not press sheet material 348 against the entirety of folding surface 364*b* (e.g., sheet material 348 is only pressed to the extent shown in FIG. 3B before housing 302 retracts away from rounded fold blade 364). For sheets that are to be positioned between the pages of this cover sheet, housing 302 can be advanced such that fold rollers 306 press against more of folding surface 364*b*, depending on the individual sheet information.

Figure 5A:
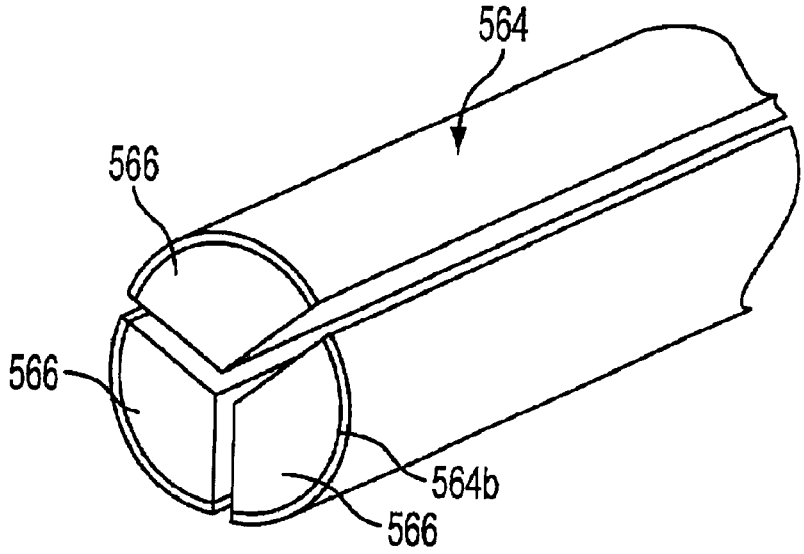
FIGS. 5A and 5B illustrate rounded fold blades with multiple blade sections in accordance with another embodiment of the present invention.
Figure 5B:
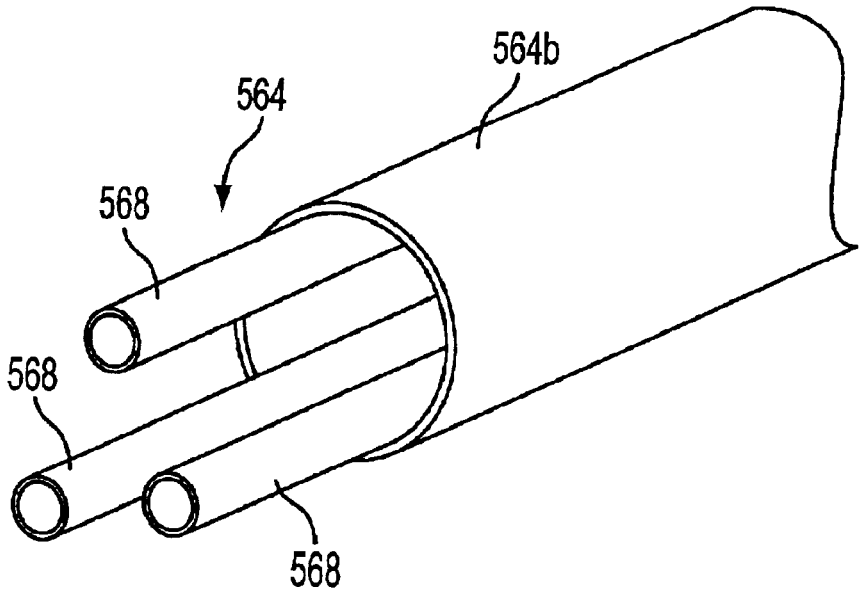

Another method of adjusting the size and/or shape of folding surface involves using a rounded fold blade 364 including multiple blade sections. FIGS. 5A and 5B illustrate perspective views of two types of multi-sectional rounded fold blades, although the present invention is not limited theses examples. Also, both of the embodiments shown in FIGS. 5A and 5B illustrate three blade sections (blade sections 566 and 568, respectively), but this number can alternatively be two or any number greater than three.

In the FIG. 5A embodiment, rounded fold blade 564 includes separate blade sections 566, where each blade section 566 is shaped as a wedge on an interior side and is rounded on an exterior side. When the three sections 566 are positioned such that they are touching or nearly touching, the combined folding surface 564*b* can have a circular (or any other rounded) cross-sectional shape. In order to vary the size and/or shape of the effective folding surface 564*b*, blade sections 566 can be moved away from or towards one another by any conventional or other actuating means. For example, a lead screw or a wedged component can be positioned between the blade sections 566 and controlled to vary the distance between them. In the FIG. 5B embodiment, rounded fold blade 564 includes three blade sections 568 and folding surface 564*b*, which can be an elastic material that changes shape and size as the distances between blade sections 568 is varied. Blade sections 568 can also be controlled to move by any conventional or other means. Using these exemplary embodiments, the size and/or shape of a rounded fold blade 564 can be adjusted to produce a rounded fold in accordance with individual sheet information.

Additionally, other methods for increasing or reshaping folding surface 564*b* can be used. For example, folding surface 564*b* can be arranged as an elastic, cylindrical chamber that changes size and/or shape based on a variance of internal pressure (e.g., from fluid or gas contained and controlled within folding surface 564*b*).

Any of the exemplary embodiments can also include a step of guiding sheet material past the fold blade with a guide, such as guide 126 in the FIG. 1A example. Guide 126 can be made of any formable material and, in the FIG. 1A example, can assist the feeding of sheet material between fold blade 104 and housing 102 by guiding sheet material over fold blade 104. In other words, use of guide 126 can prevent a leading edge of a sheet material from contacting a face of fold blade 104, and thereby can prevent jamming of sheet material during a feeding step. Also, guide 126 can be arranged to pivot about pivot points $P_4$ in the x-axis such that guide 126 moves (e.g., rotates) away from fold blade 104 as a fold is formed. This action prevents guide 126 from interfering with a folding process and can be accomplished with the use of a guide coupling, such as guide coupling 130, attached between housing 102 and guide 126. Alternatively, guide 126 can be arranged to move away from fold blade 104 by any other means, such as a linear translation along rails 128, as a non-limiting example. Also, guide 126 features from any or all of the following copending applications, all filed on even date herewith, the disclosures of which are hereby incorporated by reference in their entirety: Sheet Folding Apparatus With Pivot Arm Fold Rollers, Thick Media Folding Method, Variable Media Thickness Folding Method, and Sheet Folding Apparatus With Rounded Fold Blade, It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A method for folding a sheet of material, comprising the steps of:

feeding a sheet material into an area between two fold rollers and a fold blade;

clamping the sheet material against the fold blade with a pinch foot; and moving the fold rollers and the fold blade relative to one another to form a fold in the sheet using the fold blade, wherein the fold rollers rotate about an axis parallel to a longitudinal axis of the fold blade, wherein the feeding step comprises the step of guiding the sheet material past the fold blade with a guide and the guide moves away from the fold blade as the fold is formed, and wherein the pinch foot retracts into a housing and maintains a pressure against the fold blade as the fold rollers and the fold blade move relative to one another and wherein the pinch foot is stationary with respect to a longitudinal axis of the fold blade.

2. The method of claim 1, wherein the fold is formed by moving the fold rollers relative to the fold blade such that the fold blade and the sheet material pass between the fold rollers.

3. The method of claim 1, comprising the step of:

scoring the sheet material with a scoring roller.

4. The method of claim 1, wherein each fold roller comprises:

multiple sub-rollers, wherein a cumulative length of the sub-rollers and spaces between the sub-rollers is at least the length of a desired fold.

5. The method of claim 1, wherein each of the fold rollers rotate about the axis in a first direction and in a second direction.

6. The method of claim 1, wherein the fold blade includes a rounded folding surface, and the method comprises the step of adjusting at least one of a size and a shape of the rounded folding surface.

7. An apparatus for folding sheet material, comprising:

a ford blade;

two fold rollers;

a pinch foot for clamping against the fold blade; and drive means for moving at least one of the fold blade and the fold rollers into operable communication with one another, wherein each of the fold rollers rotates about an axis parallel to a longitudinal axis of the fold blade, wherein the pinch foot retracts into a housing and maintains a pressure against the fold blade as the fold rollers and the fold blade move relative to one another and wherein the pinch foot is stationary with respect to the longitudinal axis of the fold blade, wherein the fold blade includes a rounded folding surface, and wherein at least one of a size and a shape of the rounded folding surface is adjustable.

8. The apparatus of claim 7, wherein the drive means comprises:

a coupling; and a lead screw attached to the coupling, wherein a rotation of the lead screw in a first direction is operable to move the fold rollers against the fold blade.

9. The apparatus of claim 8, comprising:

a housing to which the fold rollers are rotatably mounted, wherein the housing is attached to the coupling.

10. The apparatus of claim 9, wherein the pinch foot is elastically mounted to the housing.

11. The apparatus of claim 10, wherein each fold roller comprises:

multiple sub-rollers.

12. The apparatus of claim 11, wherein the pinch foot is positioned in a space between two sub-rollers.

13. The apparatus of claim 7, wherein the fold blade is positioned in a plane which passes between the fold rollers.

14. The apparatus of claim 7, wherein the housing comprises:

two fold flaps for forcing a sheet material around the fold blade.

15. The apparatus of claim 14, wherein the fold flaps are pivotably biased towards each other.

16. The apparatus of claim 14, wherein the fold rollers are rotatably mounted on the fold flaps such that the fold rollers are biased towards each other.

17. The apparatus of claim 7, wherein the drive means moves the fold roller along linear path orthogonal to the sheet material to be folded.

18. The apparatus of claim 7, wherein each of the fold rollers rotate about the axis in a first direction and in a second direction.

* * * * *